United States Patent [19]

Fossas

[11] Patent Number: 4,718,252

[45] Date of Patent: Jan. 12, 1988

[54] NECKLACE VARIATION FOR A BODY ORNAMENT INCLUDING BALANCING MEANS

[76] Inventor: Jeannette M. Fossas, Wilson 1085, Santurce, P.R. 00907

[21] Appl. No.: 811,461

[22] Filed: Dec. 20, 1985

[51] Int. Cl.[4] ..... A44C 15/00

[52] U.S. Cl. ..... 63/2; D11/11

[58] Field of Search ..... 63/2, 1 R, 3, 4; D11/9, D11/11, 3

[56] References Cited

U.S. PATENT DOCUMENTS

| | | | |
|---|---|---|---|
| 107,264 | 11/1937 | Sand | D11/12 |
| D. 166,353 | 4/1952 | Philippe | D11/9 |
| 177,349 | 2/1955 | Sharp et al. | D11/12 |
| 238,292 | 12/1975 | Durante | D11/11 |
| 244,126 | 4/1977 | Ladjimi | D11/11 |
| 1,829,880 | 11/1931 | Stockert | 63/2 |
| 3,481,155 | 12/1969 | Cook | 63/2 |

OTHER PUBLICATIONS

Sew Business, Oct. 1973, p. 49 (Wallbead advertizement).

*Primary Examiner*—Richard J. Johnson
*Attorney, Agent, or Firm*—John J. Byrne

[57] ABSTRACT

This invention relates to a balancing means provided as part of an ornament worn around the neck for maintaining an inertial balance and predetermined degree of symmetry about the neck while alleviating or completely eliminating pressure directly exerted on the neck. More particularly, the balancing means includes shoulder rests on different portions of a closable loop necklace ornament, and also balancing weights on other different portions on the loop.

20 Claims, 9 Drawing Figures

NECKLACE VARIATION FOR A BODY ORNAMENT INCLUDING BALANCING MEANS

BACKGROUND OF THE INVENTION

Ornaments worn around the neck are generally referred to as a necklace. Necklaces may be of many different structural configurations, thick or thin, rigid or flexible, solid or hollow, heavy or light, smooth or disjointed and continuously coupled or attachably connected . . . etc. Necklaces may be used in combination with a pendant of any kind or other jewelry to enhance their ornamental appeal. But, whatever the design, whatever the configuration, a necklace, as up to now conceived, must remain around the wearer's neck. A necklace ordinarily forms a closed loop encircling and thus latching on to the neck. The problem with necklaces of the prior art is that as the diameter of the necklace gets larger, the necklace portion before or behind the neck would tend to droop downward thus pulling on the opposing side of the necklace which would in turn lodge forcibly against the neck. The resulting effect of this condition is the degeneration of necklace symmetry and inertial balance about the neck when worn, and undesirable pressure exerted against the front or back side of the neck. This lost of symmetry and balance is evidenced by a lob-sided configuration in which one portion of the necklace is lodged against the neck and the portion directly across the necklace diameter from said one portion is the furthest away from the neck.

OBJECT OF INVENTION

It is an object of the instant invention to provide a balancing means for maintaining appreciable symmetry around the neck when the necklace diameter becomes larger, as a necklace variation or other similar ornaments.

It is an object of the instant invention to rest a necklace firmly upon the shoulders of the wearer.

It is an object of the instant invention to centrally balance necklaces or other similar ornament on a wearer's shoulders.

It is also an object of the instant invention to include balancing inertia units on opposing sides of a necklace or similar ornament.

It is also an objective of the instant invention to include shoulder rests as part of a necklace or similar ornament.

It is also an objective of the instant invention to effect a combination of the aforesaid objectives.

SUMMARY OF INVENTION

A balancing means provided as part of an ornament worn around the neck including shoulder rests and balancing weights for balancing the ornament and maintaining appreciable symmetry about the neck while alleviating or completely eliminating pressure directly exerted on the neck.

DETAILED DESCRIPTION OF DRAWINGS

DETAILED DESCRIPTION

Figure 1:
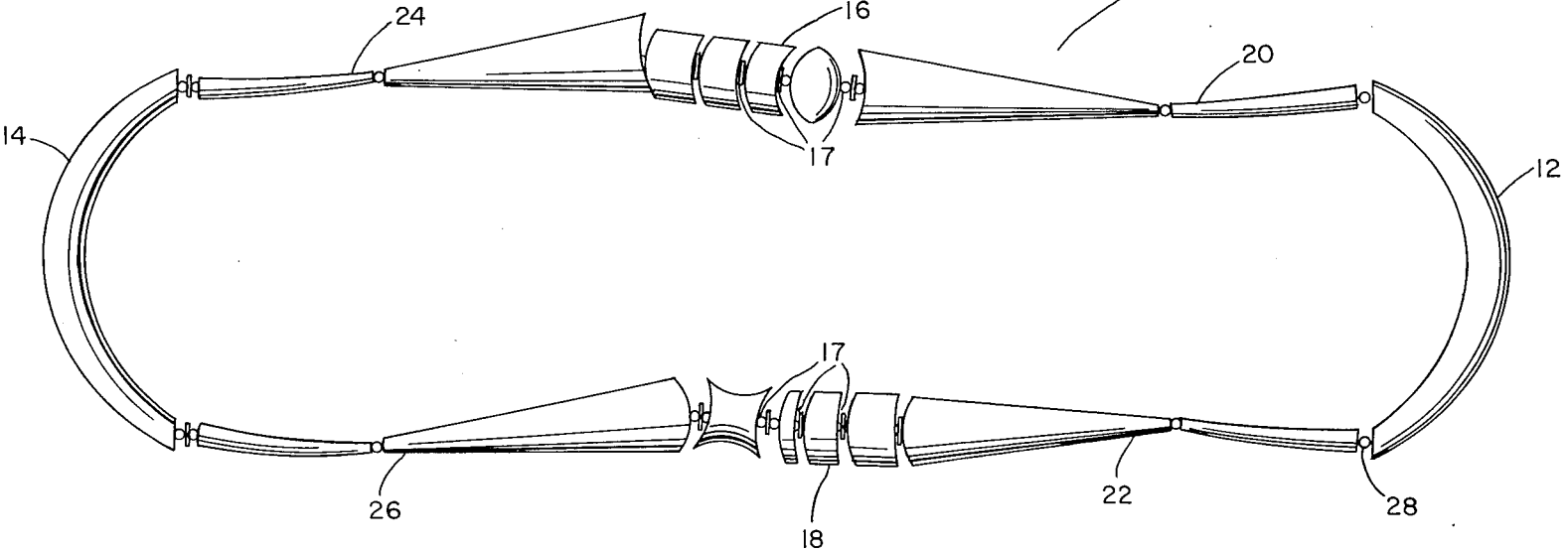
FIG. 1 shows a balancing means in accordance to a preferred embodiment of the invention, constituting parts of a necklace type ornament.

Referring to the drawings wherein like numbers indicate like parts, FIG. 1 shows one embodiment of the instant invention in a necklace type ornament 10. The necklace 10 comprises shoulder rests 12 and 14, balancing weight units formed by ornaments 16, 18, 20, 22, 24, and 26 strung together by a linked chain 28. Shoulder rests 12 and 14 are located at opposing ends of the necklace with weight pieces 16 and 18 situated therebetween. In between each shoulder rest, the weight unit are ornaments of aesthetic design. Furthermore, the weight units themselves may be of aesthetic design. In FIG. 1, the ornaments 20, 22, 24 and 26 are shown as including two separate and smaller ornaments; however, it should be understood that these ornaments may be of arbitrary design and configuration having one or many pieces. The shoulder rests 12 and 14 as shown are hollow and rigid rods such that the connecting chain can pass easily therethrough.

If the rests are rigid, their curvature may not fit every wearer comfortably; thus it may be desirable to have a range of varied curvature for the shoulder or some kind of mechanism to adapt to different sizes which would accommodate to a wide spectrum of wearers.

Figure 2B:
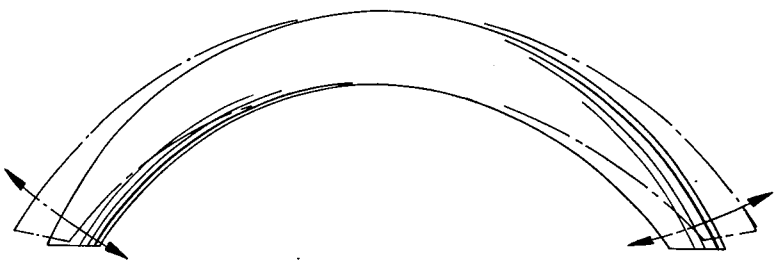
FIG. 2B shows a shoulder rest of the balancing means of FIG. 1 made of flexible material.
Figure 2A:
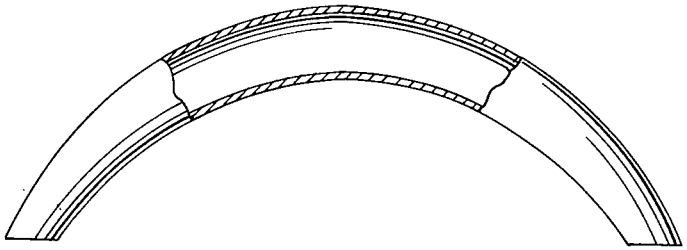
FIG. 2A shows a rigid shoulder rest of the balancing means of FIG. 1.

In another embodiment of the instant invention, the shoulder rests may be made of flexible material such that the same shoulder rests may accommodate the particular physique of a wide range of wearers, thus eliminating a need to have varying sizes of shoulder rests. FIG. 2A shows a rigid shoulder rest; FIG. 2B shows a flexible shoulder rest.

Figure 3A:
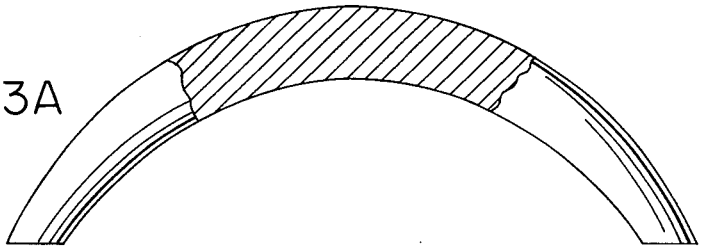
FIG. 3A shows a shoulder rest in form of a solid rod.

In another embodiment of the instant invention, the shoulder rests may not be hollow but is a solid rod coupled at its ends to the connecting chain. FIG. 3A shows such an arrangement.

Figure 3B:
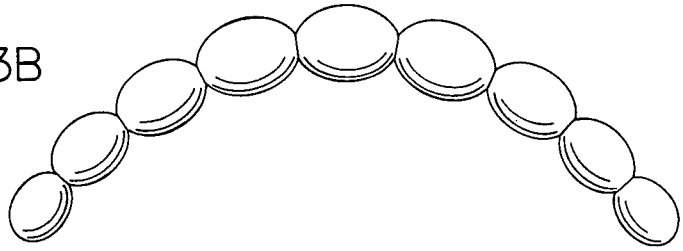
FIG. 3B shows a shoulder rest in form of soldered links.

In another embodiment of the instant invention, the shoulder rests may not be rods at all but are preshaped soldered links with fixed curvature. FIG. 3B shows such an arrangement.

Figure 4:
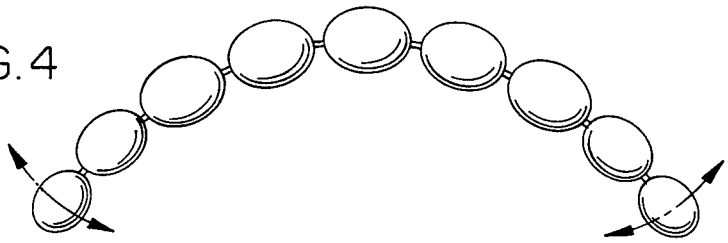
FIG. 4 shows a flexible shoulder rest made of rigid material flexibly linked.

In another embodiment of the instant invention, the shoulder rests may not be made of flexible material and yet still fit flexibly over the wearer's shoulders. The flexibility may be derived via mechanical connections such as that illustrated in FIG. 4. A plurality of subunits are flexibly linked and thus wrap around the shoulder due to gravitational pull from the weight units on front and back.

The weight units on front and back of necklace shown in FIG. 1 comprise a plurality of pieces. It should be understood that these pieces may be of equal or varying weight, that total mass of units 16 and 18 are not necessarily equal, that units 16 and 18 may each have many mass pieces of varying weight or just one mass piece, and that the number of mass pieces respectively in units 16 and 18 are not necessarily equal.

It should be understood that the connecting chain in any of the embodiments of the instant invention may be a linked chain, a string of any kind, a cord, a wire, or any other kind of thread or fiber capable of stranding together elemental pieces of a necklace type ornament in any way. It may be generally referred to as a connecting means.

Figure 5A:
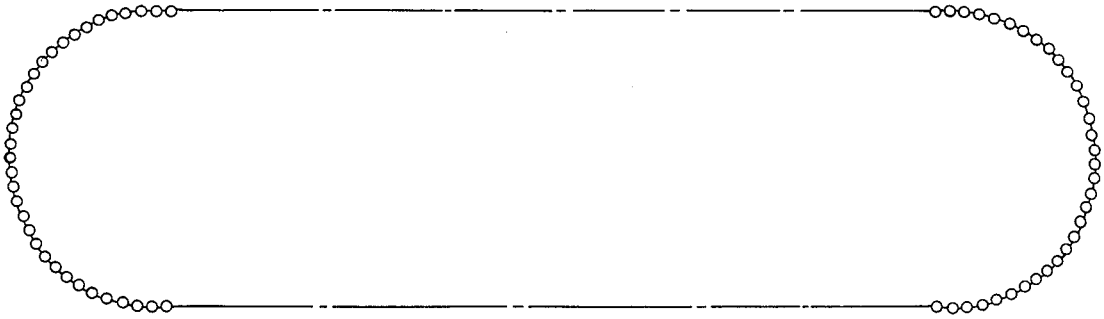
FIG. 5A shows an enclosed connecting chain, without any operable means for opening the same.
Figure 5B:
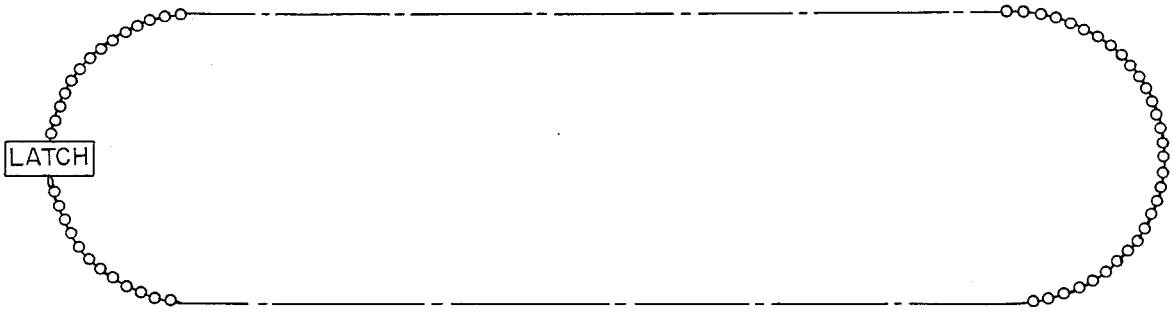
FIG. 5B shows an enclosed connecting chain having a means for opening the loop.

Furthermore, this connecting means may either be permanently enclosed or controllably opened for adding, removing, or replacing, any of the other elements of the instant invention. FIG. 5A shows a generic connecting means of this type which is permanently enclosed. FIG. 5B shows a generic connecting means of this type which includes a control portion for opening and closing the chain loop. With the arrangement in FIG. 5B, the weight units may be altered relative to its respective total mass so as to adjust the balance. There may be more than one such opening portions on the chain means. The openings may be located between two adjacent portions of the connecting chain, between a shoulder rest and a chain portion, between a chain portion and a weight unit, between pieces in a weight unit, or between any other adjacent portions of two elements in the necklace ornament. Furthermore, these opening controls may be comprised of portions of one or more other elements in the necklace ornament. The opening controls may be any kind of latch for opening or closing a chained loop.

Figure 6:
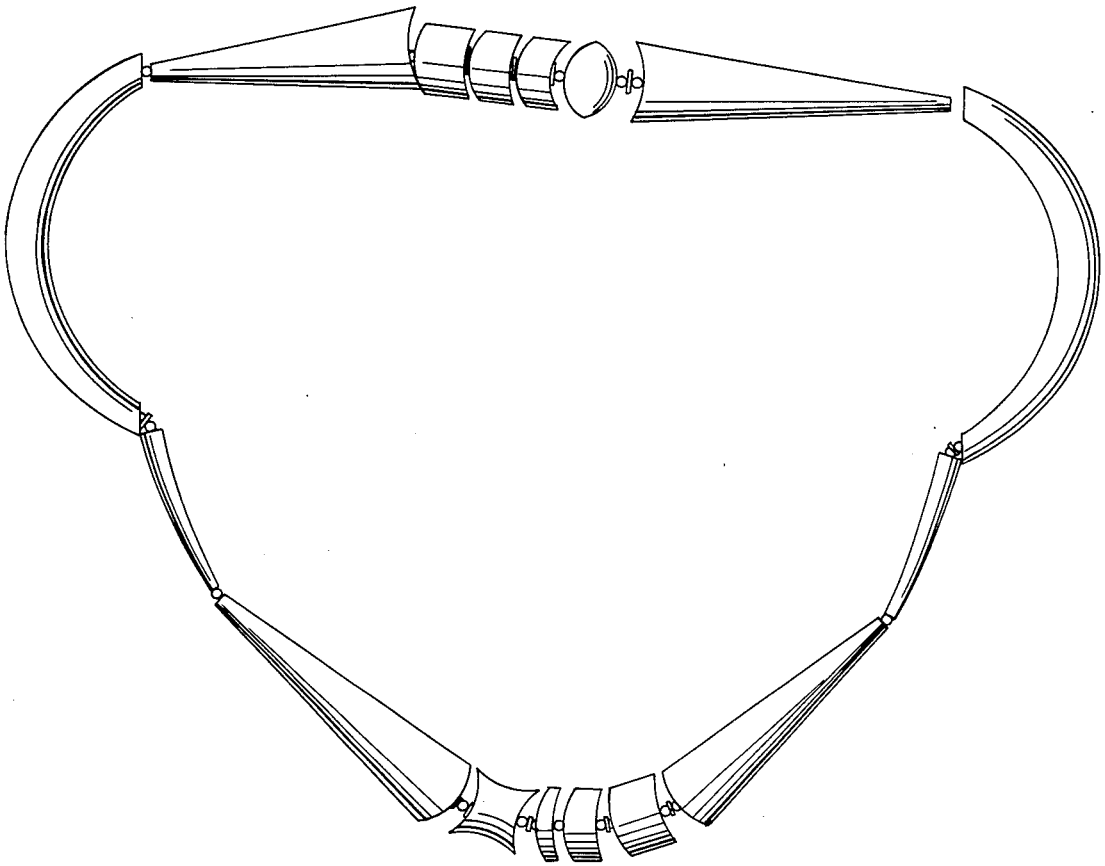
FIG. 6 shows a balancing means in accordance to another embodiment of the invention, wherein the front and back portions with respect to the shoulder rests are asymmetrical.

It should be understood that the distance from one shoulder rest to the other via one side of the connecting means is not necessarily equal to that via the other side. If they were equidistant, the necklace would be substantially symmetrical when worn. A variation in the distance detracts from this symmetry would achieve various objectives mentioned herein. FIG. 6 shows such an asymmetrical configuration. It also would eliminate the problem of complete lob-sidedness of the prior art discussed in the Background of the Invention.

FIG. 1 shows weight units as having holes through which the chain is strung. It should be understood that other variations for coupling the weight units to the chain may just as well be suitable, such as coupling each mass piece at its opposing ends instead of threading it through a bore, or tying the mass pieces to the connecting chain, etc.

In describing the invention, reference has been made to several preferred embodiments. Those skilled in the art, however, and familiar with the disclosure of the subject invention, may recognize additions, deletions, substitutions, modifications, and/or other changes which will fall within the purview of the invention as defined in the following claims.

I claim:

1. In a necklace variation for a body ornament having a closable loop with at least four separately identifiable portions thereof, a first arcuate shoulder rest connected between a first and a second one of said portions for fitting over and conforming to a wearer's shoulder and supporting said ornament;

a second arcuate shoulder rest connected between a third and a fourth one of said portions for fitting over and generally conforming to the other of said wearer's shoulders and supporting said ornament;

a first weight unit connected between said first and third portions for translating its gravitational pull to said first and second arcuate shoulder rests;

a second weight unit connected between said second and fourth portions for translating its gravitational pull to said first and second arcuate shoulder rests and operably counter balancing said first weight unit;

whereby said first and second shoulder rests establish relatively fixed and stable contacts with said wearer's shoulders.

2. An apparatus as defined in claim 1, wherein said first and second shoulder rests are made of flexible material and is flexibly shaped.

3. An apparatus as defined in claim 1, wherein said first and second shoulder rests are made of inflexible material and is rigidly shaped.

4. An apparatus as defined in claim 3, wherein said first and second shoulder rests respectively comprises soldered links.

5. An apparatus as defined in claim 2 or 3, wherein said first and second shoulder rests respectfully comprises a hollow rod.

6. An apparatus as defined in claims 1, 2, 3, or 4, wherein the distance between said first and second shoulder rests measured via a loop section including said second and fourth portions and said second weight unit is not of substantially equal length as measured via a loop section including said first and third portions and said first weight unit.

7. An apparatus as defined in claims 1, 2, 3, or 4, wherein the distance between said first and second shoulder rests measured via a loop section including said first and third portions and said equal length as measured via a loop section including said second and fourth portions and said second weight unit.

8. An apparatus as defined in claim 7, wherein said first and second weight units are of substantially equal mass.

9. An apparatus as defined in claim 7, wherein loop sections between said first and second shoulder rests on opposing sides of said wearer are essentially symmetrically dispositioned about said wearer's neck.

10. An apparatus as defined in claim 6, wherein loop sections between said first and second shoulder rests on opposing sides of said wearer are asymmetrically dispositioned about said wearer's neck.

11. An apparatus as defined in claim 9, wherein said first and second shoulder rests respectively includes a plurality of attached elements.

12. An apparatus as defined in claim 10, wherein said first and second weight units respectively include a plurality of mass elements.

13. An apparatus as defined in claim 11, wherein said first and second weight unit respectively includes a plurality of attached mass elements.

14. An apparatus as defined in claim 12, wherein said ornament further comprises a means for opening said closable loop at at least one point along said loop.

15. An apparatus as defined in claim 13, wherein said closable loop is permanently enclosed and no practical means is provided for opening said loop.

16. An apparatus as defined in claim 13, wherein said ornament further comprises a means for opening said closable loop at at least one point along said loop.

17. An apparatus as defined in claim 12, wherein said closable loop is permanently enclosed and no practical means is provided for opening said loop.

18. An apparatus as defined in claim 5, wherein a single chain strings together and connects all said first and second shoulder rests, said first, second, third, and fourth portions, and said first and second weight unit.

19. An apparatus as defined in claim 18, wherein loop sections between said first and second shoulder rests on opposing sides of said wearer are essentially symmetrically disposed.

20. An apparatus as defined in claim 18, wherein loop sections between said first and second shoulder rests on opposing sides of said wearer are asymmetrically dispositioned about said wearer's neck.

* * * * *